US007564351B2

(12) United States Patent
Nagelski et al.

(10) Patent No.: US 7,564,351 B2
(45) Date of Patent: Jul. 21, 2009

(54) THEFT DETERRENT DEVICE FOR USE WITH SLIDING DOORS

(75) Inventors: Keith C. Nagelski, Huntersville, NC (US); Nicholas M. Sedon, Weddington, NC (US)

(73) Assignee: Invue Security Products Inc., Charlotte, NC (US)

( * ) Notice: Subject to any disclaimer, the term of this patent is extended or adjusted under 35 U.S.C. 154(b) by 262 days.

(21) Appl. No.: 11/519,543

(22) Filed: Sep. 12, 2006

(65) Prior Publication Data

US 2008/0068163 A1 Mar. 20, 2008

(51) Int. Cl.
*G08B 13/08* (2006.01)

(52) U.S. Cl. ..... 340/545.6; 340/547; 200/61.71

(58) Field of Classification Search ..... 340/545.6, 340/545.1, 546, 547, 545.7–545.9; 335/205; 116/86; 200/61.71, 61.75
See application file for complete search history.

(56) References Cited

U.S. PATENT DOCUMENTS 4,271,338 A * 6/1981 Rakocy ..... 200/61.71
4,292,629 A * 9/1981 Kerr et al. ..... 340/547
4,438,430 A * 3/1984 Young et al. ..... 340/547
5,007,199 A * 4/1991 Dunagan et al. ..... 340/547
5,332,992 A 7/1994 Woods
5,350,894 A * 9/1994 Allison ..... 200/61.71
5,489,890 A * 2/1996 Moser ..... 340/546
5,530,428 A 6/1996 Woods
5,635,887 A * 6/1997 Fischette et al. ..... 335/205
5,673,021 A 9/1997 Woods
5,880,659 A 3/1999 Woods
5,977,873 A 11/1999 Woods
6,737,969 B2 5/2004 Carlson et al.
6,812,837 B2 * 11/2004 Ikeuchi ..... 340/545.1
7,199,688 B2 * 4/2007 Edmonson, Jr. ..... 335/205
7,265,672 B1 * 9/2007 Guaragna ..... 340/547
7,312,705 B2 * 12/2007 Garavuso et al. ..... 340/547
2004/0227407 A1 * 11/2004 Nagai ..... 340/686.1
2005/0174204 A1 8/2005 Gilmore
2007/0109097 A1 * 5/2007 Coutermarsh et al. ..... 340/5.73

FOREIGN PATENT DOCUMENTS

JP 2003/187341 7/2003

* cited by examiner

*Primary Examiner*—John A Tweel, Jr.
(74) *Attorney, Agent, or Firm*—Christopher C. Dremann

(57) ABSTRACT

A theft-deterrent device includes first and second members mountable on a pair of sliding doors for activating an alarm when the doors are opened, and is particularly useful with a display cabinet containing items of merchandise and having transparent sliding doors. The alarm may be mounted on the cabinet with a tether connecting the alarm and one of the first and second members. Preferably, a magnet and a magnetically activated switch are carried by the first and second members so that when the magnet moves away from the switch, an electrical circuit opens to activate the alarm. The first member is connected to one door with a portion adjacent one side of the door and a portion extending around the end of the door. The second member is connected to the other door and is preferably a thin member which fits between the doors when opened.

21 Claims, 5 Drawing Sheets

THEFT DETERRENT DEVICE FOR USE WITH SLIDING DOORS

BACKGROUND OF THE INVENTION

1. Technical Field

The present invention relates generally to theft deterrent devices. More particularly, the invention relates to such devices which activate an alarm upon attempted theft of an item of merchandise. Specifically, the invention relates to such devices used with sliding doors, such as those used in a display cabinet containing items of merchandise.

2. Background Information

In the world of security, there are a host of theft deterrent devices configured to prevent the theft of items of merchandise. Many of these devices are mounted directly to an item of merchandise to, for example, either sound an alarm upon an attempted theft or to make the item of merchandise unusable even if stolen. Electronic article surveillance (EAS) tags are often used on small items to sound an alarm if a potential thief attempts to remove the item from a store or to some unauthorized area. While devices which are mounted on the item of merchandise have proven useful in many situations, they are also cumbersome in that they must be attached to each item of merchandise.

One solution to this problem has been the use of display cabinets in which multiple items may be displayed so that they are visible through walls or doors formed of glass or another transparent material. However, such display cabinets are usually locked with a locking mechanism which requires a key to open the doors of the display cabinet. Often such display cabinets include several glass walls through which a potential customer can view the items while the lockable door is positioned away from the customer and accessible only to an employee on the other side of the display cabinet or display case. Such display cases typically utilize doors which are made of metal, wood or other materials which are not transparent. While locking mechanisms may be known for securing to sliding glass doors, such mechanisms are often rather awkward to use. In addition, the use of glass or other brittle transparent materials tends to limit the type of devices which may be used with such materials.

Thus, it would be useful to have a theft deterrent device which is suitable for use with sliding doors and particularly those doors formed of glass or other transparent materials.

BRIEF SUMMARY OF THE INVENTION

A theft-deterrent device for use with a first structure and a sliding door disposed adjacent the first structure and slidable relative thereto; the device comprising an alarm; a first member adapted to be connected to the first structure; a second member adapted to be connected to the sliding door; wherein one of the first and second members is in communication with the alarm; and wherein the second member is movable relative to the first member between a first position adjacent the first member and a second position for activating the alarm.

DETAILED DESCRIPTION OF THE INVENTION

Figure 1:
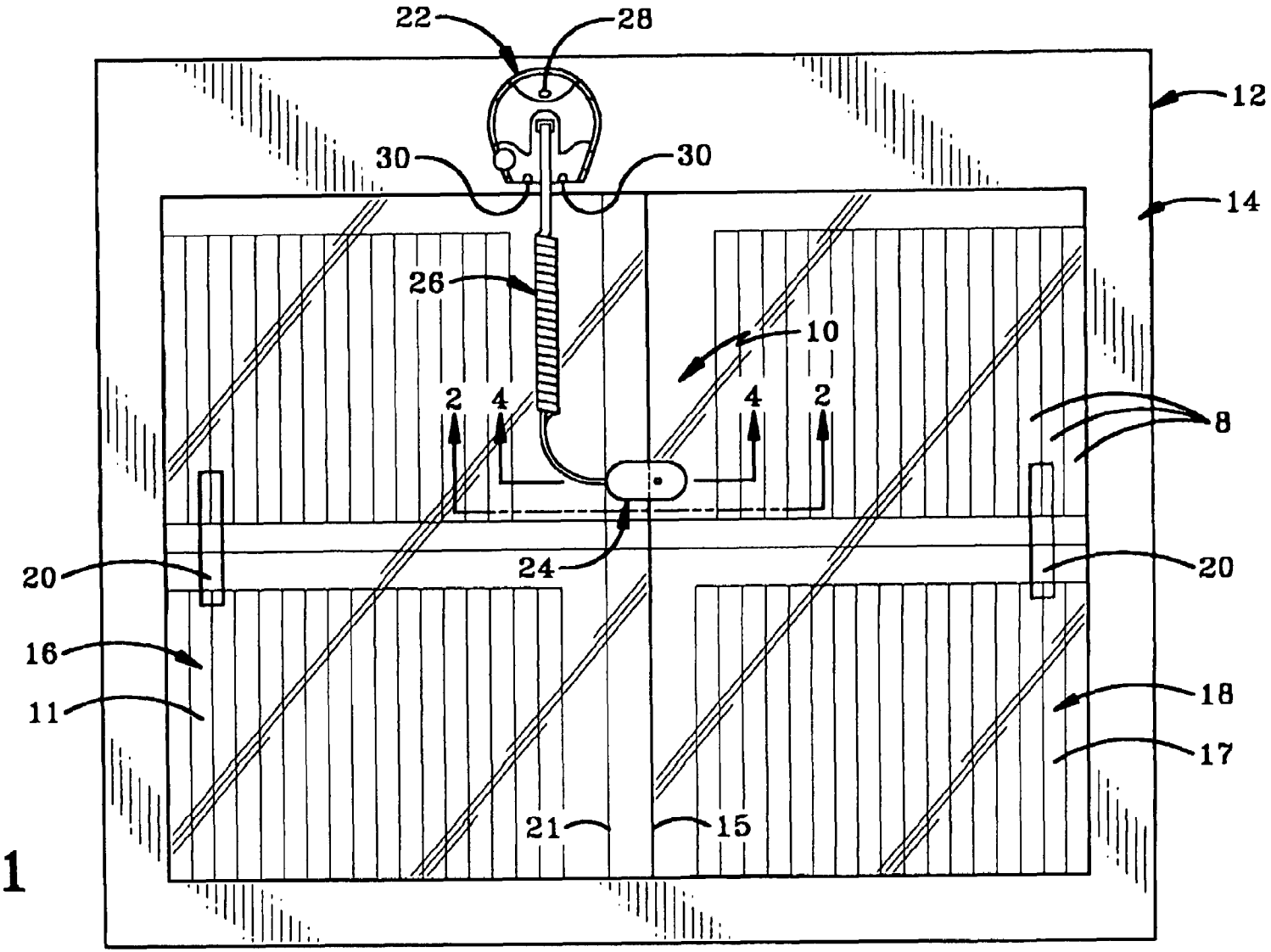
FIG. 1 is a front elevational view of the theft deterrent device of the present invention shown mounted on the display cabinet.
Figures 2, 3:
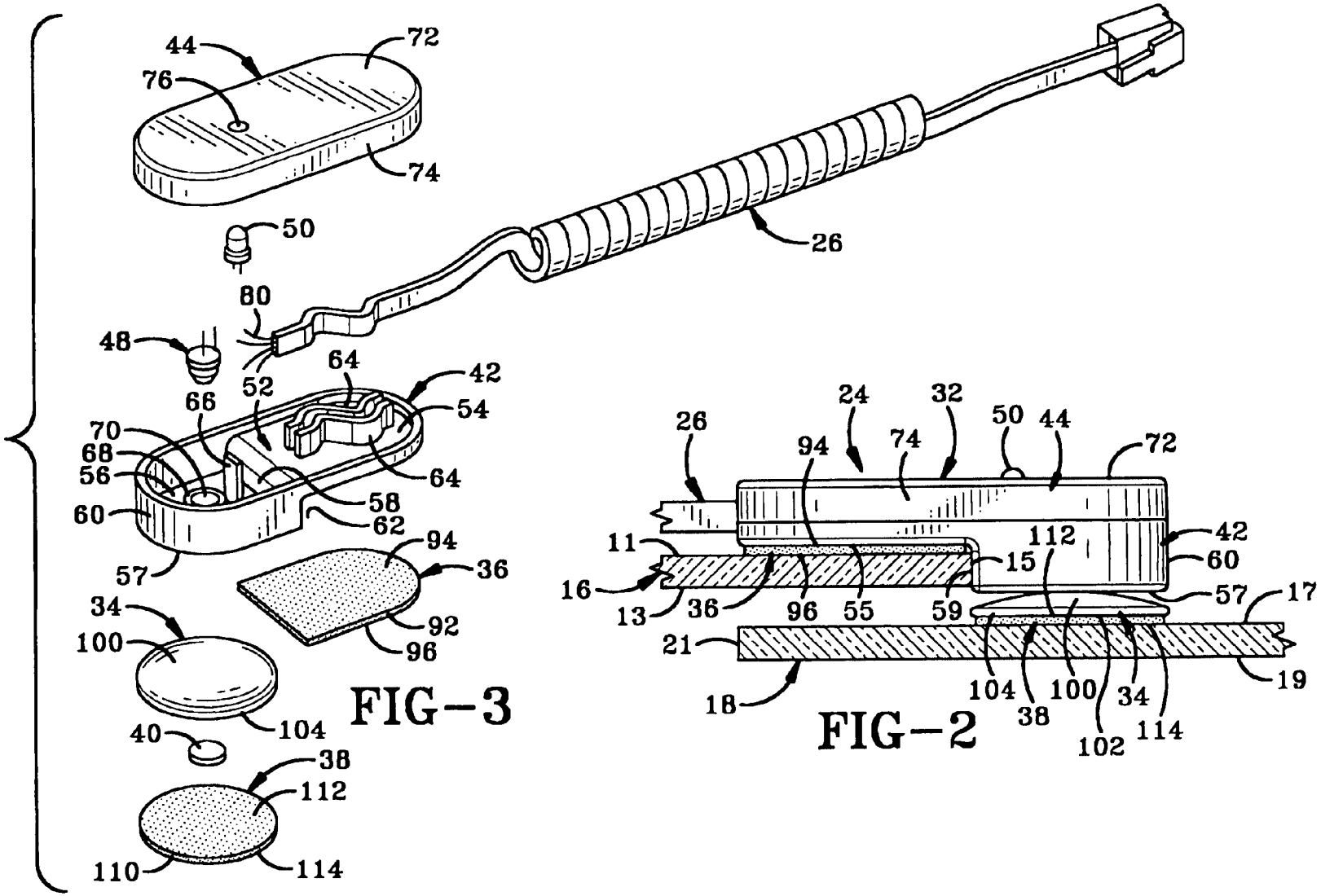
FIG. 2 is a sectional view taken on line 2-2 of FIG. 1 and shows the first and second members mounted on the sliding doors in the non-activated position.
FIG. 3 is an exploded perspective view of the first and second members and the tether.

The theft deterrent device of the present invention is indicated generally at 10 in FIGS. 1-3. Referring to FIG. 1, device 10 is mounted on a display cabinet 12 which contains items 8 of merchandise and includes a rigid frame 14 and first and second sliding doors 16 and 18 which are slidably mounted on frame 14. Frame 14 includes a pair of upper tracks or channels and a pair of lower tracks or channels (not shown) in which doors 16 and 18 are slidably disposed adjacent one another. Doors 16 and 18 are flat and disposed in parallel planes which are offset and adjacent one another. Each of doors 16 and 18 defines an indentation 20 which provides a handle for opening and closing the doors. Doors 16 and 18 are typically formed of glass or another transparent material. Door 16 has first and second flat parallel sides 11 and 13. Door 16 also has an end 15 which is perpendicular to sides 11 and 13. Likewise, second door 18 has first and second opposed flat parallel sides 17 and 19 and an end 21 extending therebetween. Portions of doors 16 and 18 adjacent ends 15 and 21 typically overlap a relatively short distance when the doors are closed.

With continued reference to FIG. 1, device 10 includes an alarm unit 22, a sensor 24 and a tether 26 connected to unit 22 and sensor 24. Alarm unit 22 includes a housing which houses an audible alarm and a visual alarm or light 28 and defines a pair of key alignment depressions 30. Device 10 is configured to activate the audible and visual alarms of unit 22 in response to a signal from sensor 24 when one of doors 16 and 18 is slid relative to the other to an open position.

Referring to FIGS. 2 and 3, sensor 24 includes a first member 32 mounted on door 16 and a second member 34 mounted on door 18. A first adhesive pad 36 connects first member 32 to door 16 and a second adhesive pad 38 adheres second member 34 to door 18. A magnet 40 is carried by second member 34. First member 32 includes a base 42 and a cover 44 which are connected together to form a housing which defines an interior chamber 46 (FIG. 4) in which is disposed a magnetically activated switch 48 and a visual arming indicator or light 50.

Base 42 includes a stepped bottom wall 52 comprising a flat upper portion 54, a flat lower portion 56 which is parallel to upper portion 54 and an intermediate portion 58 which extends perpendicularly between and is connected to portions 54 and 56. Upper portion 54 has a first flat outer surface 55. Lower portion 56 has a second flat outer surface 57 which is parallel to surface 55 and is offset therefrom so that surfaces 55 and 57 lie in offset parallel planes. Intermediate portion 58 has a third flat outer surface 59 which is perpendicular to surfaces 55 and 57. A side wall 60 extends upwardly from bottom wall 52 and includes a pair of opposed straight sections and a pair of opposed arcuate sections. Upper portion 54 and intermediate portion 58 of wall 52 define therebetween a door receiving space 62 for receiving therein a portion of sliding door 16. A pair of convoluted walls 64 extend upwardly from upper portion 54 to define therebetween a convoluted passage for receiving a portion of tether 26 therebetween to secure tether 26 to first member 32. A retaining post 66 extends upwardly from lower portion 56 for retaining light 50 when member 32 is assembled. A cylinder 68 also extends upwardly from lower portion 56 and defines a space 70 therewithin for receiving therein switch 48.

Cover 44 includes a top wall 72 and a side wall 74 which is connected to and extends downwardly therefrom. Side wall 74 has a pair of parallel straight portions and a pair of opposed arcuate portions so that side wall 74 and side wall 60 of base 42 align with one another and have the same outer perimeter configuration. Top wall 72 defines a through hole 76 for receiving a portion of light 50, which extends above top wall 72 when assembled. Cover 44 further includes a retaining post 78 (FIG. 4) for retaining switch 48 within space 70. Tether 26 includes electrical conductors 80 which are in electrical communication with electrical connectors of switch 48 and light 50. Conductors 80 are also in electrical communication with the alarms of alarm unit 22 as well as an electric power source which may be a battery carried by unit 22. Unit 22 may alternately be wired to receive electrical power from an electrical outlet. Conductors 80 are part of a sense loop which if compromised activates the alarms of unit 22.

Figure 4:
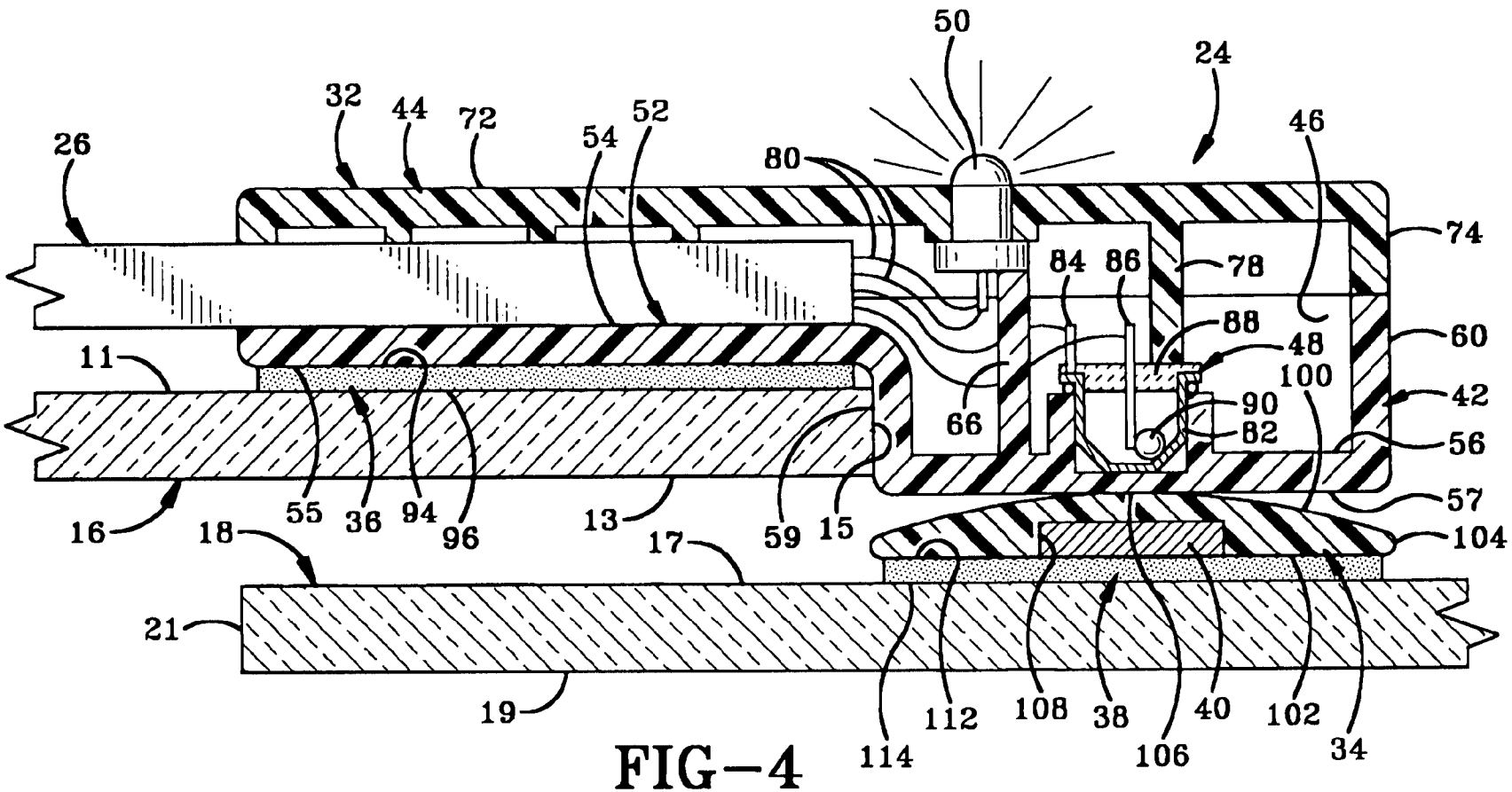
FIG. 4 is a sectional view taken on line 4-4 of FIG. 1. showing the first and second members mounted on the sliding doors in the non-activated position.

Referring to FIG. 4, switch 48 includes an electrically conductive housing 82, first and second electrical connectors 84 and 86, a disk 88 which includes an insulator and a magnet and a magnetically attractable member in the form of a ball or sphere 90. Connector 84 is in electrical communication with housing 82 and one of conductors 80. Connector 86 is in electrical communication with one of conductors 80 and is supported by disk 88 in a manner which insulates it electrically from housing 82. FIG. 4 shows sphere 90 in a closed circuit position in which it provides electrical communication between connector 86 and housing 82 to provide a closed circuit in which the alarm of unit 22 is armed. Switch 48 is more completely described in U.S. Pat. No. 5,977,873 granted to Woods, which is incorporated herein by reference.

Referring to FIGS. 2 and 3, first adhesive pad 36 includes a central layer 92 which is typically formed of an elastomer or other resilient compressible material, most typically being a foam. Pad 36 further includes first and second adhesive layers 94 and 96 connected on opposite sides to central layer 92. Adhesive layer 94 is adhered to outer surface 55 of upper portion 54 of bottom wall 52. Second adhesive layer 96 is connected to first side 11 of door 16 adjacent end 15 thereof. When first member 32 is mounted on door 16, flat surface 59 abuts or is closely adjacent to end 15 of door 16.

Referring to FIGS. 2-4, second member 34 is a substantially flat circular disk which is formed as a single piece. Member 34 has a first or upper side 100, an opposed second or lower side 102 (FIG. 2) and a circular outer perimeter 104. Side 100 is dome shaped or convex and includes a peak 106 (FIG. 4) which is centrally located so that member 34 is radially symmetrical about an axis passing through peak 106. Thus, first side 100 tapers from peak 106 toward outer perimeter 104 and second side 102. The tapered surface of side 100 helps to eliminate any catching between members 32 and 34 during the sliding movement of one or both of doors 16 and 18 while allowing members 32 and 34 to contact one another at peak 106 and outer surface 57 of lower portion 56. Member 34 further defines a magnet receiving space 108 (FIG. 4) which extends inwardly from side 102 and is centrally located so that magnet 40 is disposed centrally and directly below peak 106. Second adhesive pad 38 includes a central layer 110 and first and second adhesive layers 112 and 114 connected to opposite sides of layer 110. Layer 110 is formed of the same materials is that of central layer 92 of pad 36. Adhesive layer 112 is connected to lower side 102 of second member 34 and second adhesive layer 114 is connected to first side 17 of door 18. The compressible nature of pad 38 in conjunction with the tapered surfaces of convex side 100 of member 34 allows for some movement of member 34 toward door 18 if the alignment between first and second members 32 and 34 is not exact when mounted on doors 16 and 18. More particularly, if peak 106 extends outwardly from first side 17 of door 18 farther than flat surface 57 of first member 32 when mounted on doors 16 and 18, the tapered surfaces of side 100 are still configured to initially engage lower surface 57 and slide therealong until peak 106 is able to contact surface 57 while pad 38 is compressed to allow member 34 to move toward door 18 to accommodate this positioning of peak 106. Likewise, first pad 34 may stretch or expand to allow first member 32 to move away from second member 34 in such a circumstance. The central layers of pads 34 and 36 are thus formed of resilient materials which are both compressible and expandable so that they return to their original positions once a force thereon is released.

Figure 5:
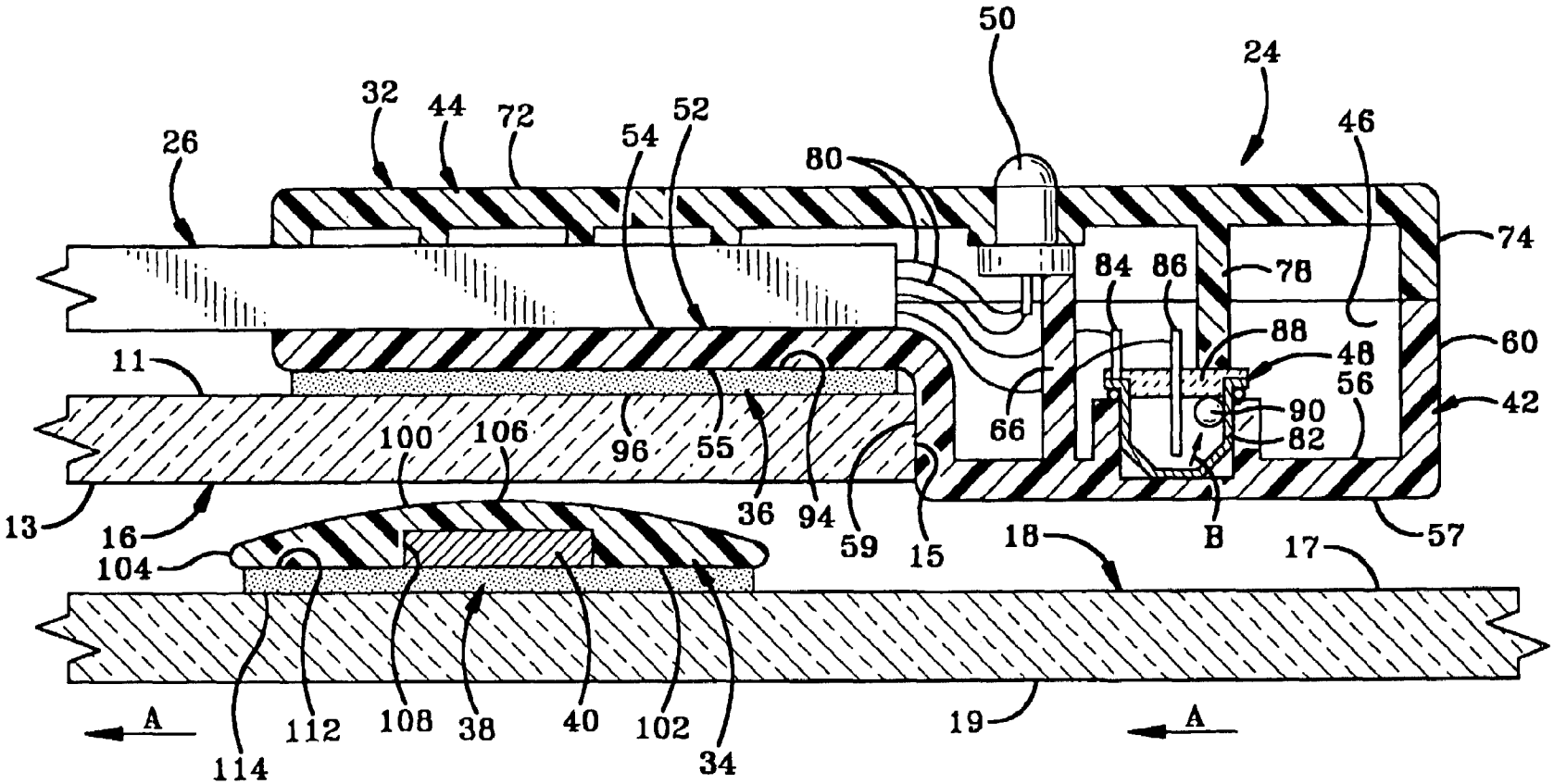
FIG. 5 is similar to FIG. 4 and shows one of the sliding doors having moved so that the first and second members are in the alarm activating position.
Figure 6:
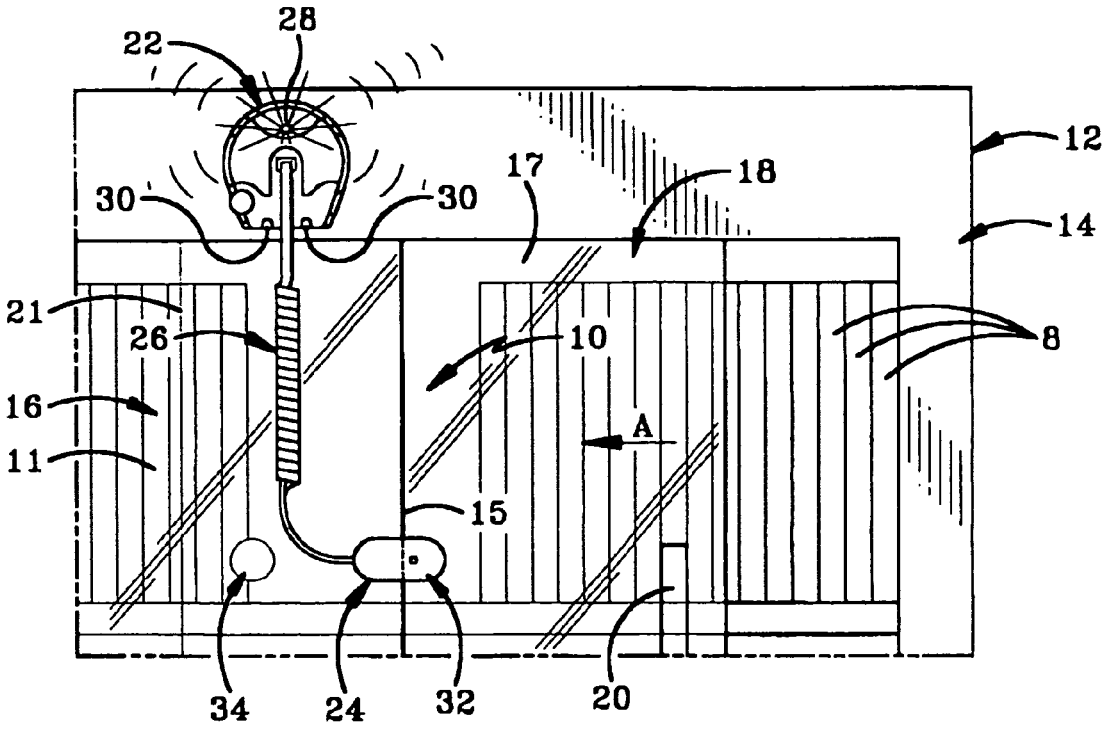
FIG. 6 is a front elevational view of a portion of the display cabinet showing one of the sliding doors having moved to move the first and second members to the alarming position so that the alarm is activated.

The operation of device 10 is now described with reference to FIGS. 4-7. FIG. 4 shows members 32 and 34 in an armed and non-alarming position. More particularly, magnet 40 attracts sphere 90 into the closed circuit position due to the fact that magnet 40 is stronger than the magnet of disk 88. The completion of this circuit also causes light 50 to be lit in a continuous or intermittent fashion to serve as an arming indicator. When one of doors 16 and 18 is slid relative to the other as shown by the sliding movement of door 18 in FIG. 5 at arrows A, second member 34 and magnet 40 slide therewith and thus move away from switch 48. When this movement occurs, sphere 90 is attracted to the magnet of disk 88 (arrow B) to an open circuit position in which sphere 90 no longer provides electrical communication between housing 82 and connector 86. The opening of this circuit causes light 50 to stop illuminating, as shown in FIG. 5, and activates the alarm of unit 22, as shown in FIG. 6. Although not shown, the opening of door 16 instead of door 18 would cause the same sequence of events leading to the activating of the alarm. It is noted that tether 26 is configured with a coiled section so that if door 16 or 18 is opened, tether 26 would be able to expand to accommodate this movement while allowing first member 32 and alarm unit 22 to remain in electrical communication with one another.

Figure 7:
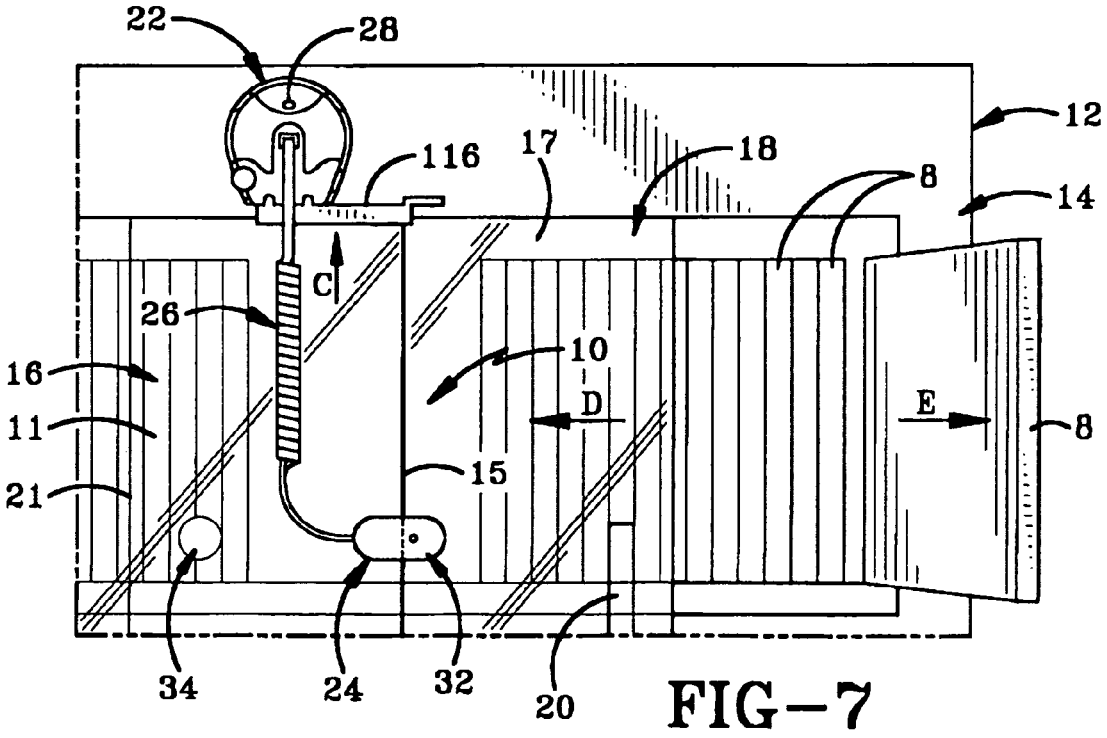
FIG. 7 is similar to FIG. 6 and shows the key disarming the alarm so that the sliding door is slid open without activating the alarm so that an item of merchandise can be removed from the display cabinet.

FIG. 7 illustrates an authorized opening of one of the doors. More particularly, a key 116 is moved into position as indicated at arrow C to disarm the alarm unit 22, which may include turning the power off. Door 18 may then be slid open as indicated at arrow D without activating the alarm and an item 8 of merchandise may then be removed from display cabinet 12 as indicated at arrow E.

Assembly 10 thus provides a relatively simple mechanism which is mountable on a display cabinet and sliding doors thereof and which activates an alarm upon the unauthorized opening of one of the sliding doors. Device 10 thus allows for the display of items of merchandise within a display case without the individual tagging of each item with some sort of theft deterrent mechanism. Device 10 also provides for members such as members 32 and 34 which are easily mountable on glass or other transparent materials and which are free of a locking mechanism for locking the sliding doors to one another. It is noted that while device 10 is typically used with a pair of sliding doors which slide parallel to one another, that device 10 may also be used with a single sliding door which is mounted adjacent a stationary structure instead of another sliding door.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A theft-deterrent device for use with a first structure and a sliding door disposed adjacent the first structure and slidable relative thereto; the device comprising:

an alarm;

a first member adapted to be connected to the first structure;

a second member adapted to be connected to the sliding door;

wherein one of the first and second members is in communication with the alarm;

wherein the second member is movable relative to the first member between a first position adjacent the first member and a second position for activating the alarm;

wherein the second member in the first position abuts the first member; and wherein one of the first and second members has a first side which slidably engages the other of the first and second members; the first side comprising a tapered portion which tapers away from the other of the first and second members when the second member is in the first position.

2. The device of claim 1 further comprising a magnet carried by one of the first and second members; and a magnetically activated switch carried by the other of the first and second members.

3. The device of claim 1 further comprising a tether connected to the alarm and to the one of the first and second members in communication with the alarm.

4. The device of claim 3 wherein the tether comprises electrical conductors which are part of a sense loop which if compromised activates the alarm.

5. The device of claim 1 wherein the one of the first and second members having a first side comprising a tapered portion is a disc.

6. The device of claim 5 further comprising a magnet carried by the disc; and a magnetically activated switch carried by the other of the first and second members.

7. The device of claim 1 wherein the second member is movable in a first direction between the first and second positions; and wherein in response to sliding engagement between the tapered portion and the other of the first and second members, one of the first and second members is movable in a second direction transverse to the first direction.

8. The device of claim 7 further comprising a resilient pad connected to the one of the first and second members movable in the second direction and adapted to allow for the movement in the second direction.

9. A theft-deterrent device for use with a first structure and a sliding door disposed adjacent the first structure and slidable relative thereto; the device comprising:

an alarm;

a first member adapted to be connected to the first structure;

a second member adapted to be connected to the sliding door;

wherein one of the first and second members is in communication with the alarm;

wherein the second member is movable relative to the first member between a first position adjacent the first member and a second position for activating the alarm; and wherein the second member comprises a first section and a second section extending outwardly therefrom so that the first and second sections define therebetween a door-receiving space adapted to receive therein a portion of the sliding door.

10. The device of claim 9 wherein the first section has a first flat surface bounding the space; and further comprising a first adhesive layer mounted on the second member along the first flat surface and adapted to connect the second member to the sliding door.

11. A theft-deterrent device for use with a first structure and a sliding door disposed adjacent the first structure and slidable relative thereto; the device comprising:

an alarm;

a first member adapted to be connected to the first structure;

a second member adapted to be connected to the sliding door;

wherein one of the first and second members is in communication with the alarm;

wherein the second member is movable relative to the first member between a first position adjacent the first member and a second position for activating the alarm; and further comprising a first adhesive layer adapted to connect the first member to the first structure; and a second adhesive layer adapted to connect the second member to the sliding door.

12. The device of claim 11 in combination with the sliding door; and wherein the sliding door comprises a transparent material to which the second adhesive layer is adhered.

13. A theft-deterrent device for use with a first structure and a sliding door disposed adjacent the first structure and slidable relative thereto; the device in combination with the first structure and the sliding door comprising:

an alarm;

a first member adapted to be connected to the first structure;

a second member adapted to be connected to the sliding door;

wherein one of the first and second members is in communication with the alarm;

wherein the second member is movable relative to the first member between a first position adjacent the first member and a second position for activating the alarm; and wherein:

the first member is connected to the first structure;

the second member is connected to the sliding door; and one of the first and second members is disposed between the first structure and the sliding door when the second member is in the second position.

14. A theft-deterrent device for use with a first structure and a sliding door disposed adjacent the first structure and slidable relative thereto; the device in combination with the first structure and the sliding door comprising:

an alarm;

a first member adapted to be connected to the first structure;

a second member adapted to be connected to the sliding door;

wherein one of the first and second members is in communication with the alarm;

wherein the second member is movable relative to the first member between a first position adjacent the first member and a second position for activating the alarm; and wherein:

the first member is connected to the first structure;

the second member is connected to the sliding door;

the sliding door has first and second opposed sides;

the second member comprises a first section adjacent and facing the first side of the sliding door and a second section which extends outwardly from the first section at least as far as the second side of the sliding door.

15. The device of claim 14 wherein the second member in the first position is closely adjacent or abuts the first member.

16. A theft-deterrent device for use with a first structure and a sliding door disposed adjacent the first structure and slidable relative thereto; the device in combination with the first structure and the sliding door comprising:

an alarm;

a first member adapted to be connected to the first structure;

a second member adapted to be connected to the sliding door;

wherein one of the first and second members is in communication with the alarm;

wherein the second member is movable relative to the first member between a first position adjacent the first member and a second position for activating the alarm; and wherein:

the first member is connected to the first structure;

the second member is connected to the sliding door;

the sliding door has a first side and an end;

the second member comprises a first section and a second section extending transversely thereto; and the first section is disposed adjacent the first side of the sliding door and the second section abuts the end of the sliding door.

17. A theft-deterrent device for use with a first structure and a sliding door disposed adjacent the first structure and slidable relative thereto; the device in combination with the first structure and the sliding door comprising:

an alarm;

a first member adapted to be connected to the first structure;

a second member adapted to be connected to the sliding door;

wherein one of the first and second members is in communication with the alarm;

wherein the second member is movable relative to the first member between a first position adjacent the first member and a second position for activating the alarm; and wherein:

the first member is connected to the first structure;

the sliding door has a first side and an end; and the second member is connected to the first side of the sliding door and includes a portion which extends outwardly beyond the end of the sliding door.

18. The device of claim 17 further comprising a magnet and a magnetically activated switch; wherein the outwardly extending portion of the second member carries one of the magnet and switch; and the first member carries the other of the magnet and switch.

19. A theft-deterrent device for use with a display cabinet having adjacent first and second doors slidingly disposed relative to one another, the device comprising:

an alarm;

a sensor in communication with the alarm, the sensor comprising a first member mounted on one of the first and second doors and a second member mounted on the other of the first and second doors;

wherein one of the first and second members carries a magnet and the other of the first and second members carries a magnetically activated switch;

wherein the first and second members are disposed adjacent one another in a non-alarming first position in which the magnet and the magnetically activated switch are operatively coupled; and wherein the sensor activates the alarm when one of the first and second members is moved from the non-alarming first position to an alarming second position in which the first and second members are not disposed adjacent one another and the magnet and the magnetically activated switch are not operatively coupled.

20. The device of claim 19 wherein the first door has first and second sides and an end extending therebetween;

wherein the second door has first and second sides, the first side of the second door facing the second side of the first door;

wherein the first member is mounted on the first side of the first door; and wherein the second member is mounted on the first side of the second door.

21. The device of claim 20 wherein the first member comprises a first section disposed adjacent the first side of the first door and a second section that extends beyond the end of the first door so that the magnet is adjacent and opposite the magnetically activated switch in the first position.

* * * * *